US005918487A

United States Patent [19]

Franceus

[11] Patent Number: 5,918,487

[45] **Date of Patent: *Jul. 6, 1999**

[54] SEALED CONTAINER FOR THE LAUNDRY SOLUTION

[75] Inventor: Ivan A. Franceus, Alpha, N.J.

[73] Assignee: North American Plastic Technologies, Inc., Frenchtown, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,007

[22] Filed: Sep. 26, 1996

[51] Int. Cl.[6] ..... D06F 39/02

[52] U.S. Cl. ..... 68/235 R; 68/17 R

[58] Field of Search ..... 68/17 R, 183, 68/235 R; 422/265; 261/120; 206/0.5

[56] References Cited

U.S. PATENT DOCUMENTS

| | | | |
|---|---|---|---|
| 4,395,261 | 7/1983 | Lutz | 206/0.5 X |
| 5,211,689 | 5/1993 | Kobayashi | 206/0.5 |

FOREIGN PATENT DOCUMENTS

| | | | |
|---|---|---|---|
| 0288345 | 10/1988 | European Pat. Off. | 68/17 R |
| 0288346 | 10/1988 | European Pat. Off. | 68/17 R |
| 222796 | 9/1988 | Japan | 68/17 R |
| 322797 | 9/1988 | Japan | 68/17 R |

OTHER PUBLICATIONS

Publication entitled "The Laundry Solution" by TradeNet Marketing, Inc. (undated).

*Primary Examiner*—Philip R. Coe

*Attorney, Agent, or Firm*—Levisohn, Lerner, Berger & Langsam

[57] ABSTRACT

A spherical container for a chemical solution is disclosed which is used in a washing machine. The spherical container maximizes the surface which interacts with the clothing being washed in the washing machine, yet there are no sharp edges or surfaces to damage the clothing. The sphere is sealed with the solution therewithin, and vapor, gas and/or charged particles are emitted which perform the cleaning function.

7 Claims, 1 Drawing Sheet

SEALED CONTAINER FOR THE LAUNDRY SOLUTION

BACKGROUND OF THE INVENTION

This invention relates to a new and novel package for a solution carried in a sealed container to emit gas, charged particles and/or other radiation to clean clothing in a washing machine.

Submitted herewith is publication entitled *The Laundry Solution*. That publication describes a process in which something is emitted, probably gas, charged particles and/or other radiation which causes a washing action in a washing machine. Such solution previously was packaged in a tube or jar which tended to leak or crack during usage. The inventors believe *The Laundry Solution* actually is a type of water treatment process but do not know, for sure.

An object of this invention is to provide an improved container for such solution which enhances the cleaning action yet prevents leakage of the solution from the container holding it.

Another object of this invention is to provide such container which has surfaces interacting with the clothing which prevents snagging, ripping or otherwise damaging the clothing, yet enhances the surface interaction between the wash water and container.

Other objects and advantages will become more apparent from the following description.

SUMMARY OF THE INVENTION

In accordance with the principles of this invention, a plastic sphere is filled with The Laundry Solution and sealed. The sphere is placed in a washing machine, and it floats in the water in the machine. As the clothing is agitated, the plastic ball interacts with the wash water releasing that which is released by The Laundry Solution's action yet ensuring that there is no leakage of the liquid sealed therein. The spherical surface provides a rounded surface which interacts with the clothing preventing snagging or ripping.

Preferably, the container or sphere is stored in a clear cylindrical container, so that the container with The Laundry Solution is easily accessible and readily visible.

DETAILED DESCRIPTION

Specific reference is made to the pre-existing publication *The Laundry Solution* to identify that material which is utilized in the present invention. Such publication is submitted herewith and is prior art. Other solutions intended to be sealed in a container to interact with wash water in a washing machine may be employed in the present invention, but the best solution presently available is The Laundry Solution. The Laundry Solution is a solution available from Aqueous Labs, 3270 West Post Road, Las Vegas, Nev. 89118, which is widely known and advertised under that name. Alternatively, other liquid solutions can be sealed in the container, as needed. As with the Laundry Solution, it is currently preferred that solutions having charged particles and/or gas be sealed within the container. It is contemplated, however, that with advances in the art, other suitable solutions may be discovered or developed.

Figure 1:
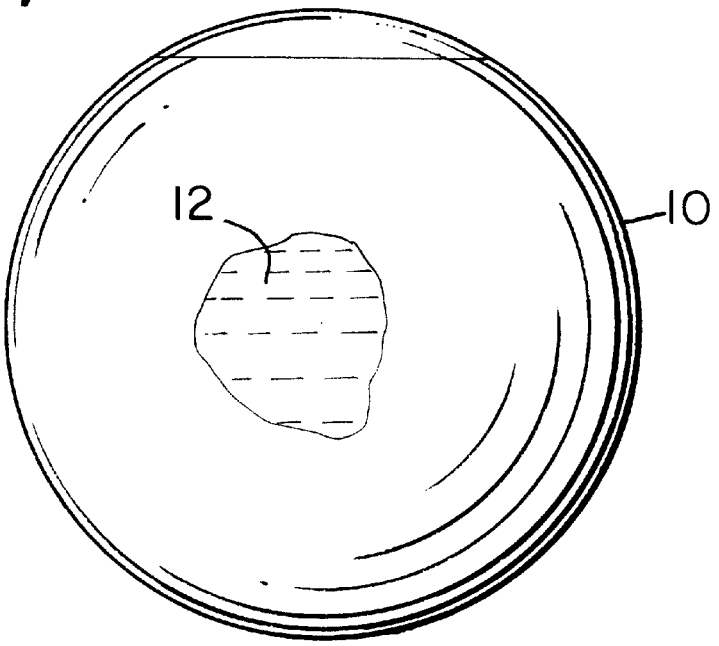
FIG. 1 is an end view of the container of this invention holding The Laundry Solution.

FIG. 1 shows a sphere 10 containing The Laundry Solution 12 with a small air space 16 therein. The sphere is made of plastic, preferably polyethylene and is filled with The Laundry Solution 12. The sphere is sealed so as to provide a closed container preventing leakage of The Laundry Solution. The polyethylene comprises microscopic holes permitting gas to pass there through without liquid leaking out therefor.

In operation, the spherical container is placed in the washing machine, and it will float on the water in the machine. The spherical container 10 will interact with the wash water and bounce against the clothing thereby releasing that which is intended to be released from The Laundry Solution. The plastic polyethylene surface will permit passage of that which is released from The Laundry Solution. One advantage of the present invention is that only rounded surfaces are presented to the clothing, so that there is little likelihood of damage to the clothing nor breakage of the surface of the container carrying The Laundry Solution. Other rounded surfaces such as elliptical or oblong may be provided, and all such containers should be made of a polyethylene or other plastic material allowing The Laundry Solution to be sealed therein while being able to bounce around and otherwise be agitated by the clothing in the washing machine during the washing operation. Even a bagel type container could be employed.

Figure 2:
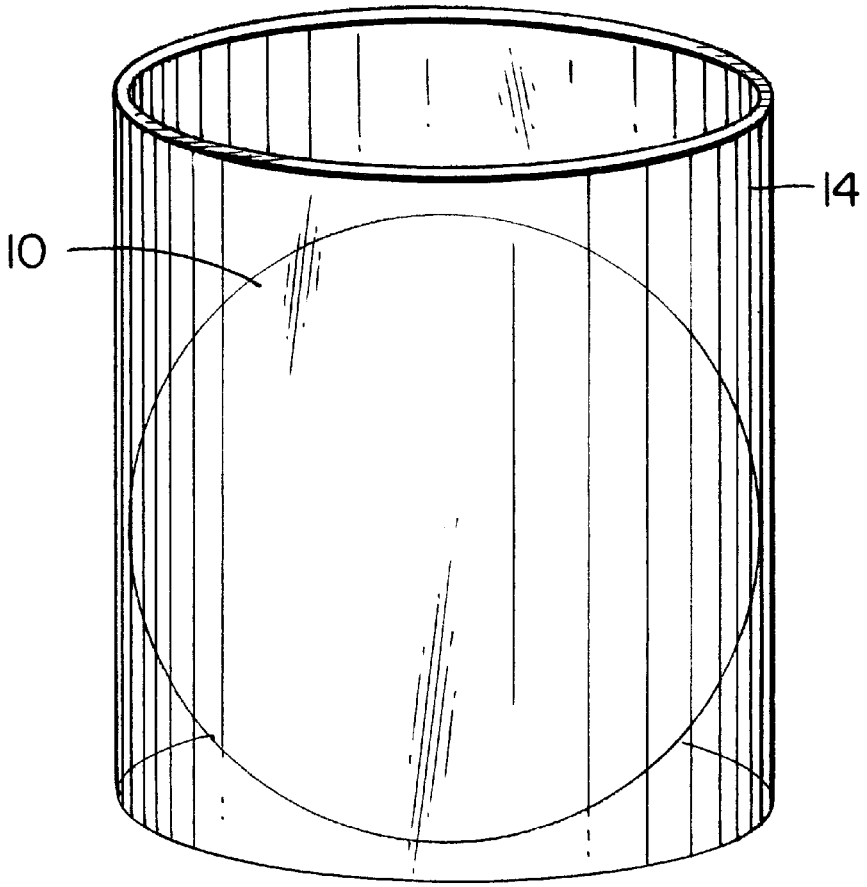
FIG. 2 is an end view of a cylindrical package housing the spherical container of this invention.

FIG. 2 illustrates a clear cylindrical container 14 adapted to hold spherical container 10 to ensure easy and reliable storage of the container 10 containing The Laundry Solution.

The above invention has been described with reference to a preferred embodiment, and other embodiments may be presented which come within the teachings of the present invention as set forth in the appended claims.

I claim as follows:

1. An apparatus for washing clothing, comprising:

(a) a washing machine for washing clothing;

(b) clothing to be washed therein; and, (c) a container located within said washing machine for cleaning said clothing during operation of said washing machine, said container comprising only rounded surface means which move against said clothing during operation of said washing machine, said container comprising a solution therein, said container preventing said solution from leaking from said container during operation of said washing machine.

2. An apparatus as claimed in claim 1, wherein said solution comprises charged particles.

3. An apparatus as claimed in claim 1, wherein said solution comprises gas.

4. An apparatus as claimed in claim 1, wherein said container comprises a sphere.

5. An apparatus as claimed in claim 1, wherein said container is made of plastic.

6. An apparatus as claimed in claim 1, wherein said plastic comprises microscopic holes allowing gas to pass through said plastic while preventing liquid from leaking therethrough.

7. An apparatus as claimed in claim 1, wherein said plastic comprises polyethylene.

* * * * *